US011211735B2

(12) United States Patent
Kobayashi et al.

(10) Patent No.: US 11,211,735 B2
(45) Date of Patent: Dec. 28, 2021

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Shingo Kobayashi, Mie (JP); Sunghyun Byun, Mie (JP)

(73) Assignees: AutoNetworks Technologies, Ltd., Mie (JP); Sumotomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 17/041,489

(22) PCT Filed: Mar. 22, 2019

(86) PCT No.: PCT/JP2019/012000
§ 371 (c)(1),
(2) Date: Sep. 25, 2020

(87) PCT Pub. No.: WO2019/193993
PCT Pub. Date: Oct. 10, 2019

(65) Prior Publication Data

US 2021/0135387 A1 May 6, 2021

(30) Foreign Application Priority Data

Apr. 4, 2018 (JP) ..... JP2018-072672

(51) Int. Cl.
*H01R 13/44* (2006.01)
*H01R 13/6585* (2011.01)

(52) U.S. Cl.
CPC ..... *H01R 13/44* (2013.01); *H01R 13/6585* (2013.01); *H01R 2201/26* (2013.01)

(58) Field of Classification Search
CPC ..... H01R 2201/26; H01R 13/44; H01R 13/5213; H01R 13/521; H01R 4/22
See application file for complete search history.

(56) References Cited

U.S. PATENT DOCUMENTS 9,774,125 B2 9/2017 Furuya et al.
10,230,191 B2 * 3/2019 Lui ..... H01R 43/16
(Continued)

FOREIGN PATENT DOCUMENTS

JP S58-147180 U 10/1983
JP 2014-179290 A 9/2014
JP 2018-022581 A 2/2018

OTHER PUBLICATIONS

International Search Report dated Jun. 11, 2019 for WO 2019/193993 A1 (4 pages).

*Primary Examiner* — Truc T Nguyen
(74) *Attorney, Agent, or Firm* — Abelman, Frayne & Schwab

(57) ABSTRACT

A connector includes terminals and shield members respectively supported in a housing, and protection caps. The terminal is in the form of a flat plate extending in an assembling direction D with a mating connector and has a contact point with a mating terminal of the mating connector on a plate surface of the terminal. The shield member surrounds the terminal to face the terminal in a direction orthogonal to the assembling direction D. The protection cap includes a front covering portion for covering a front end part in the assembling direction D of the terminal and locking claws locked to the shield member, and is fixed to the shield member by locking of the locking claws. The connector 10 is coupled to the mating connector with the
(Continued)

protection caps fixed to the shield members and front end parts of the terminals covered by the front covering portions.

6 Claims, 4 Drawing Sheets

(56) References Cited

U.S. PATENT DOCUMENTS

| | | | | |
|---|---|---|---|---|
| 10,855,018 | B2 * | 12/2020 | Duenkel | H01M 50/543 |
| 2011/0275234 | A1 * | 11/2011 | Schmidt | H01R 13/631<br>439/345 |
| 2016/0064849 | A1 | 3/2016 | Eckel | |
| 2021/0265248 | A1 * | 8/2021 | Yao | H01L 21/4803 |
| 2021/0265862 | A1 * | 8/2021 | Yeo | H02J 50/10 |

* cited by examiner

CONNECTOR

CROSS REFERENCE TO RELATED APPLICATIONS

This application is a national phase of PCT application No. PCT/JP2019/012000, filed on 22 Mar. 2019, which claims priority from Japanese patent application No. 2018-072672, filed on 4 Apr. 2018, all of which are incorporated herein by reference.

TECHNICAL FIELD

The present invention relates to a connector.

BACKGROUND

Conventionally, a high-voltage connector used, for example, in a hybrid or electric vehicle needs to be provided with an electric shock prevention structure so that a worker handling the connector does not get electrically shocked due to the touch of a terminal by his/her finger, a tool or the like. For example, Patent Document 1 discloses a connector which prevents a tool or a worker's finger from touching male terminals by a moving plate configured to slide between a forward position where the front ends of the male terminals are pulled into the plate and a rearward position where the male terminals project forward.

PRIOR ART DOCUMENT

Patent Document

Patent Document 1: JP 2017-84486A

SUMMARY OF THE INVENTION

Problems to be Solved

In an electric shock prevention structure by the moving plate as described above, there is a problem that the structure is complicated. Thus, there has been a room for improvement on this point.

The present invention was developed to solve the above problem and aims to provide a connector capable of preventing an electric shock by a simple configuration.

Means to Solve the Problem

A connector for solving the above problem includes a housing open toward a front side in an assembling direction with a mating connector, a terminal supported in the housing, the terminal being in the form of a flat plate extending in the assembling direction, a shield member made of metal, the shield member being supported in the housing, the shield member surrounding the terminal to face the terminal in a direction orthogonal to the assembling direction, and a protection cap including a front covering portion for covering a front end part in the assembling direction of the terminal and a locking portion locked to the shield member, the protection cap being fixed to the shield member by locking of the locking portion, the connector being coupled to the mating connector with the protection cap fixed to the shield member and the front end part of the terminal covered by the front covering portion, a contact point with a mating terminal of the mating connector being provided on a plate surface of the terminal.

According to the above aspect, an electric shock due to the touch of the terminal by a worker's finger, a tool or the like can be prevented by a simple configuration of merely assembling and fixing the protection cap including the front covering portion for covering the front end part of the terminal with and to the shield member. Further, the connector can be coupled to the mating connector with the protection cap assembled.

A connector for solving the above problem includes a housing open toward a front side in an assembling direction with a mating connector, a terminal supported in the housing, the terminal being in the form of a flat plate extending in the assembling direction, and a protection cap including a front covering portion for covering a front end part in the assembling direction of the terminal and a locking portion locked to the housing, the protection cap being fixed to the housing by locking of the locking portion, the connector being coupled to the mating connector with the protection cap fixed to the housing and the front end part of the terminal covered by the front covering portion, a contact point with a mating terminal of the mating connector being provided on a plate surface of the terminal.

According to the above aspect, an electric shock due to the touch of the terminal by a worker's finger, a tool or the like can be prevented by a simple configuration of merely assembling and fixing the protection cap including the front covering portion for covering the front end part of the terminal with and to the housing. Further, the connector can be coupled to the mating connector with the protection cap assembled.

In the above connectors, the protection cap includes a pair of side covering portions extending from the front covering portion to respectively cover both end parts of the terminal in the direction orthogonal to the assembling direction, and the locking portion is provided on each side covering portion.

According to the above aspect, since the both end parts of the terminal are covered by the side covering portions of the protection cap, a worker's finger, a tool or the like can be made more unlikely to touch the terminal.

In the above connectors, the protection cap includes projecting portions projecting along a plate thickness direction of the terminal from both end parts of the front covering portion in a direction orthogonal to the assembling direction and parallel to the plate surface of the terminal.

According to the above aspect, a worker's finger, a tool or the like can be made more unlikely to touch the terminal by the projecting portions of the protection cap.

Effect of the Invention

According to the connector of the present invention, it is possible to prevent an electric shock by a simple configuration.

DETAILED DESCRIPTION TO EXECUTE THE INVENTION

Figure 1:
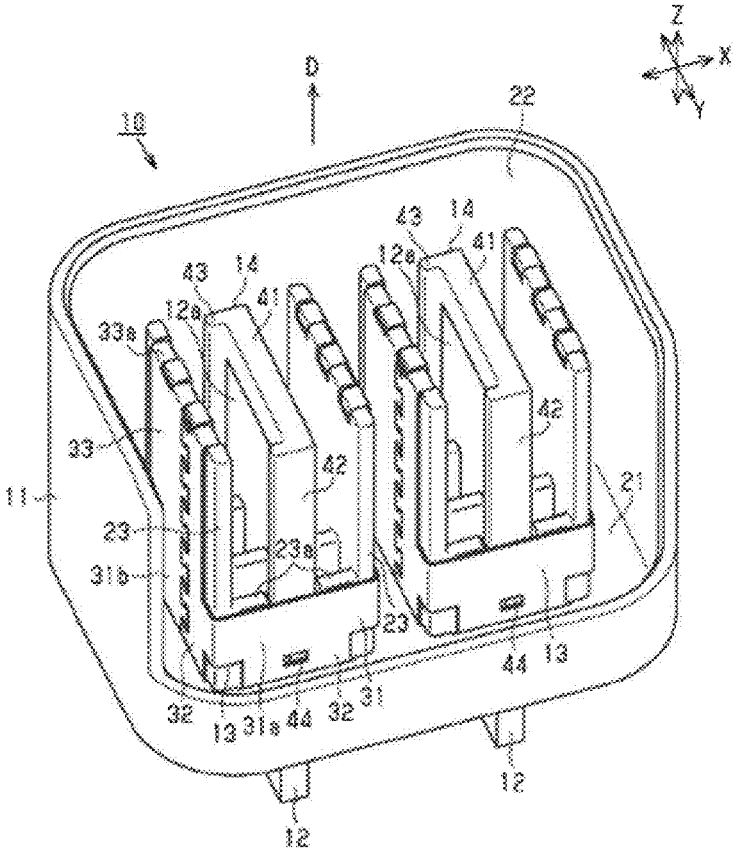
FIG. 1 is a perspective view of a connector of an embodiment.

Hereinafter, one embodiment of a connector is described with reference to the drawings. Note that XYZ axes in the drawings are based on an orthogonal coordinate system of FIG. 1, wherein the X axis represents a width direction of the connector, the Y axis represents a depth direction of the connector orthogonal to the X axis and the Z axis represents a height direction of the connector orthogonal to an XY plane.

The connector 10 of this embodiment shown in FIG. 1 is a high-voltage connector, for example, used in a hybrid or electric vehicle and, for example, connected to a mating connector provided on an end part of a wiring harness. Note that an assembly direction (direction along a Z-axis direction) of the connector 10 with the mating connector is indicated by an arrow D (hereinafter, referred to as the assembly direction D).

The connector 10 includes a housing 11 made of resin such as insulating resin, a pair of terminals 12 (male terminals) provided in the housing 11, a pair of shield members 13 provided in the housing 11 to respectively correspond to the pair of terminals 12, and a pair of protection caps 14 fixed to the shield members 13 to respectively partially cover the pair of terminals 12.

As shown in FIGS. 1 to 4, the both terminals 12 have the same shape. Each terminal 12 is in the form of a flat plate extending in the Z-axis direction and arranged such that a plate surface 12*a* (principal surface) thereof is orthogonal to an X-axis direction (width direction of the connector 10). Further, the terminals 12 are provided side by side in the X-axis direction. The plate surface 12*a* of each terminal 12 forms a contact point with an unillustrated mating terminal (female terminal) of the mating connector. Note that the pair of terminals 12 are respectively electrically connected to a plus-side wire and a minus-side wire. Further, the pair of terminals 12 and peripheral structures (the pair of shield members 13, the pair of protection caps 14 and housing shape) thereof are symmetrical with each other with respect to the width direction of the connector 10. Further, in this embodiment, both plate surfaces of the terminal 12 (the plate surface 12*a* forming the contact point with the mating terminal and the back of the plate surface 12*a*) are not covered by the protection cap 14.

The housing 11 includes a base portion 21 in the form of a flat plate extending along the XY plane, a peripheral wall portion 22 extending in the assembly direction D from the base portion 21 and shield holding walls 23 extending in the assembly direction D from the base portion 21 inside the peripheral wall portion 22. The base portion 21 includes a pair of terminal insertion holes 24 penetrating in the Z-axis direction (see FIGS. 3 and 4). The respective terminals 12 are inserted and held in the respective terminal insertion holes 24.

The peripheral wall portion 22 is formed into a partially cut annular shape, and open toward a front side in the assembly direction D with the mating connector. Each terminal 12 extends in the assembly direction D from the terminal insertion hole 24 of the base portion 21 and is located inside the peripheral wall portion 22. The mating connector is fit to the peripheral wall portion 22 and the plate surfaces 12*a* of the respective terminals 12 are in contact with the mating terminals of the mating connector in that fit state. Note that the mating terminal is configured to contact the plate surface 12*a* of the terminal 12 with a resilient force acting in the X-axis direction.

The shield holding walls 23 are respectively provided on both sides of the respective terminals 12 in the X-axis direction (width direction of the connector 10). Specifically, a pair of the shield holding walls 23 are provided for each of the plus and minus terminals 12, and the terminal 12 is arranged between the pair of shield holding walls 23.

Each shield member 13 is made of a metal plate material, which is a conductive material, and the both shield members 13 have the same shape. The shield member 13 includes a surrounding portion 31 having an annular shape (annular shape when viewed in the Z-axis direction parallel to the assembly direction D) to surround the terminal 12. The surrounding portion 31 includes a pair of first side parts 31*a* orthogonal to a Y-axis direction (depth direction of the connector 10) and a pair of second side parts 31*b* orthogonal to the X-axis direction (width direction of the connector 10) and has a substantially rectangular annular shape when viewed in the Z-axis direction by being composed of the respective first side parts 31*a* and the second side parts 31*b*. In the terminal 12, a part projecting in the assembly direction D from the base portion 21 (terminal insertion hole 24) serves as a projecting part 12*b* (see FIGS. 3 and 4), and the surrounding portion 31 surrounds a base end part (fixed end part) of the projecting part 12*b*.

The respective first side parts 31*a* of the surrounding portion 31 are perpendicular to the plate surface 12*a* of the terminal 12 and facing both end parts 12*c* in the Y-axis direction of the terminal 12. Further, the second side parts 31*b* of the surrounding portion 31 are parallel to the plate surface 12*a* of the terminal 12. Each of the first and second side parts 31*a*, 31*b* is formed with an extending locking portion 32 extending toward the base portion 21 of the housing 11. Each extending locking portion 32 penetrates through the base portion 21 in the Z-axis direction and a tip part (rear end part in the assembly direction D) thereof is bent on the back side (side opposite to the surrounding portion 22) of the base portion 21. In this way, each extending locking portion 32 is locked to the base portion 21 in the Z-axis direction.

The shield member 13 includes extending portions 33 extending along the assembly direction D from the respective second side parts 31*b* of the surrounding portion 31. The respective extending portions 33 are provided on both sides in the X-axis direction of the terminal 12. The respective extending portions 33 are provided along the outer side surfaces (side surfaces opposite to inner side surfaces facing the terminal 12) of the shield holding walls 23. Further, each extending portion 33 includes a plurality of locking claws 33*a* locked to a tip part (front end part in the assembly direction D) of the shield holding wall 23.

The shield holding wall 23 is formed with extending walls 23*a* extending inward (toward the terminal 12) in the X-axis direction from both end parts in the Y-axis direction thereof. The respective first side parts 31*a* of the surrounding portion 31 are provided along the outer side surfaces of the extending walls 23*a*.

The protection cap 14 is provided to prevent an electric shock and made of synthetic resin such as insulating resin. The protection cap 14 includes a front covering portion 41 for covering a front end part 12*d* in the assembly direction D of the terminal 12. A thickness in the X-axis direction of the front covering portion 41 is equal to a plate thickness of the terminal 12. Further, one side surface in the X-axis direction of the front covering portion 41 is flush with the plate surface 12*a* (surface having the contact point with the mating connector) of the terminal 12. A rear end surface in the assembly direction D of the front covering portion 41 is in contact with the front end part 12*d* of the terminal 12. Further, in the Z-axis direction, a length from the base portion 21 to a front end part in the assembly direction D of the front covering portion 41 is set substantially equal to lengths of the shield holding walls 23 and the extending portions 33 of the shield member 13.

Figure 4:
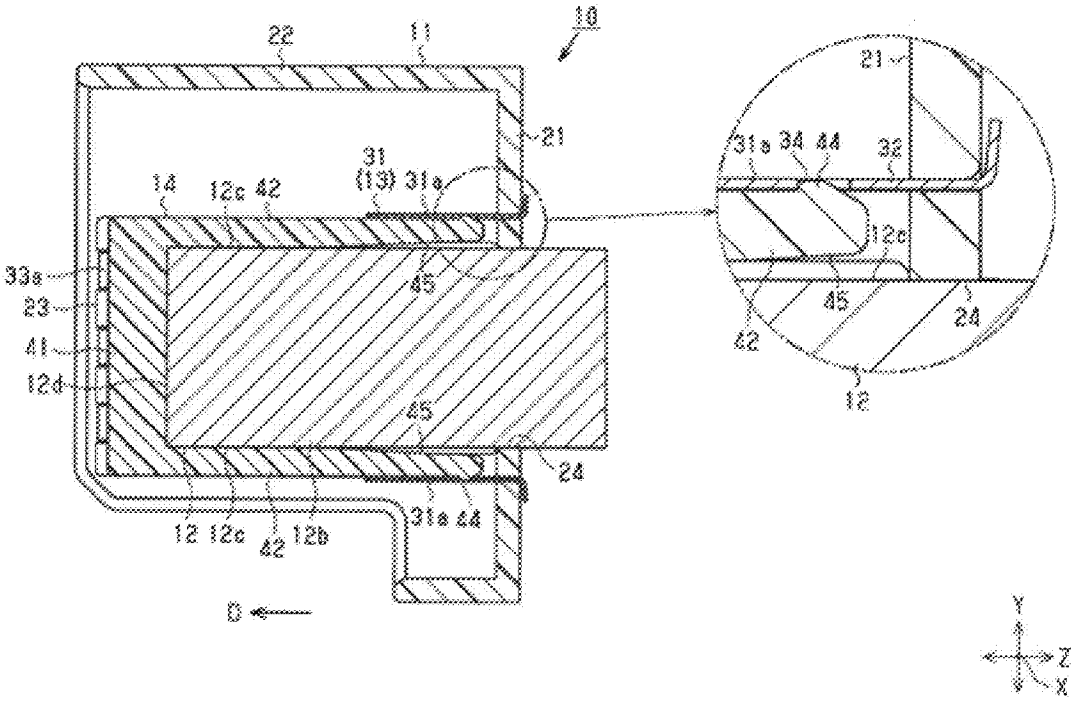
FIG. 4 is a section along 4-4 in FIG. 2.

As shown in FIGS. 1 and 4, the protection cap 14 includes a pair of side covering portions 42 extending along end parts 12*c* (end parts in the Y-axis direction) of the terminal 12 from both end parts in the Y-axis direction of the front covering portion 41. The respective side covering portions 42 are in contact with the respective end parts 12*c* in the Y-axis direction of the terminal 12. Specifically, the respective side covering portions 42 cover the respective end parts 12*c* of the terminal 12.

Figure 2:
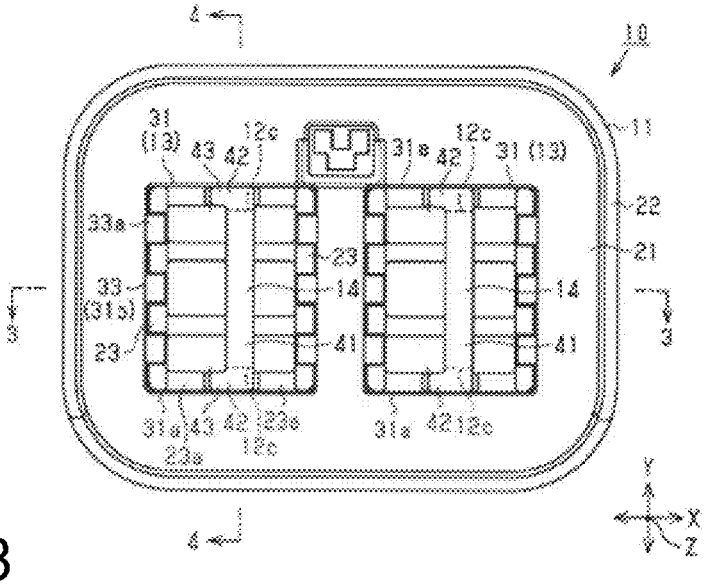
FIG. 2 is a side view of the connector of FIG. 1 viewed from an extending direction of terminals.
Figure 3:
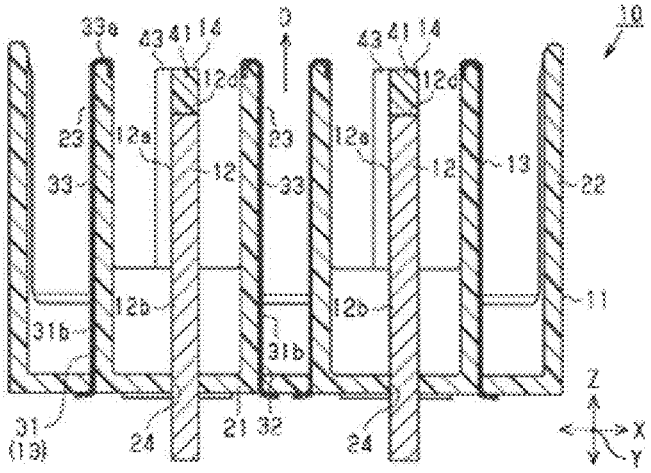
FIG. 3 is a section along 3-3 in FIG. 2.

As shown in FIGS. 1 to 3, projecting portions 43 projecting toward one side in the X-axis direction are respectively formed on both end edges in the Y-axis direction of the protection cap 14. Each projecting portion 43 projects along the plate thickness direction of the terminal 12. The projecting portion 43 is formed from one end to the other end in the Z-axis direction of the protection cap 14. Specifically, the projecting portion 43 is formed from the front end part in the assembly direction D of the front covering portion 41 to a rear end part in the assembly direction D of the side covering portion 42. Note that a projecting length of the projecting portion 43 from the plate surface 12*a* of the terminal 12 is set smaller than the plate thickness of the terminal 12.

In an assembled state of the protection cap 14, the side covering portions 42 are inserted between the end parts 12*c* in the Y-axis direction of the terminal 12 and the first side parts 31*a* (surrounding portion 31) of the shield member 13 (see FIG. 2). Further, the side covering portion 42 is arranged between a pair of the extending walls 23*a* facing each other in the X-axis direction.

As shown in FIG. 4, a locking claw 44 projecting outward in the Y-axis direction (toward a side opposite to the terminal 12) is formed on the rear end part in the assembly direction D of each side covering portion 42. The locking claw 44 is inserted into a locking hole 34 formed to penetrate through the first side part 31*a* of the shield member 13 in the Y-axis direction to be locked. In this way, the protection cap 14 is fixed to the shield member 13 while partially covering the terminal 12. Note that, in the assembled state of the protection cap 14, clearances are formed between the rear end parts of the side covering portions 42 and the base portion 21 of the housing 11.

Further, an inclined surface 45 inclined to be separated from the terminal 12 toward a rear end side (free end side) is formed on the inner side surface in the Y-axis direction of the side covering portion 42, and a clearance is formed between this inclined surface 45 and the end part 12*c* of the terminal 12. In this way, when the protection cap 14 is assembled in the Z-axis direction (direction opposite to the assembly direction D), each side covering portion 42 can be temporarily deflected inward in the Y-axis direction (toward the terminal 12) by contact with the first side part 31*a* of the shield member 13 and the locking claw 44 of each side covering portion 42 can be inserted into the locking hole 34 of the first side part 31*a* to be locked by the side covering portion 42 resiliently returning. Further, if the locking claws 44 are unlocked from the locking holes 34 by deflecting the side covering portions 42 inward in the Y-axis direction, the protection cap 14 can be removed.

Functions of this embodiment are described.

The front covering portion 41 of the protection cap 14 and the shield holding walls 23 are facing each other in the X-axis direction, and intervals between those front covering portion 41 and shield holding walls 23 are set to such a dimension that a test finger (not shown) based on safety standards cannot touch the terminal 12. In this way, it is suppressed that a worker gets electrically shocked due to the touch of the terminal 12 by his/her finger, a tool or the like. Further, with the protection caps 14 fixed to the shield members 13 (with the front end parts 12*d* of the terminals 12 covered by the front covering portions 41), the connector 10 can be coupled to the mating connector and the mating terminals can be brought into contact with the plate surfaces 12*a* of the terminals 12 of the connector 10.

Effects of this embodiment are described.

(1) The protection cap 14 includes the front covering portion 41 for covering the front end part 12*d* in the assembly direction D of the terminal 12 and the locking claws 44 locked to the shield member 13, and the protection cap 14 is fixed to the shield member 13 by the locking of the locking claws 44. Therefore, an electric shock due to the touch of the terminal 12 by a worker's finger, a tool or the like can be prevented by a simple configuration of merely assembling and fixing the protection cap 14 including the front covering portion 41 for covering the front end part 12*d* of the terminal 12 with and to the shield member 13.

(2) The connector 10 can be coupled to the mating connector with the protection caps 14 fixed to the shield members 13 (with the front end parts 12*d* of the terminals 12 covered by the front covering portions 41). Thus, at the time of coupling the connector 10 to the mating connector, the protection caps 14 need not be removed and an electric shock due to the touch of the terminal 12 can be more suitably prevented.

(3) The protection cap 14 includes the pair of side covering portions 42 extending from the front covering portion 41 to respectively cover the both end parts 12*c* of the terminal 12 in the direction (Y-axis direction) orthogonal to the assembly direction D, and the locking claw 44 is provided on each side covering portion 42. Since the both end parts 12*c* of the terminal 12 are covered by the side covering portions 42 of the protection cap 14 in this way, a worker's finger, a tool or the like can be made more unlikely to touch the terminal 12.

(4) The protection cap 14 includes the projecting portions 43 projecting along the plate thickness direction (X-axis direction) of the terminal 12 from the both end parts of the front covering portion 41 in the direction (Y-axis direction) orthogonal to the assembly direction D and parallel to the plate surface 12*a* of the terminal 12. Thus, a worker's finger, a tool or the like can be made more unlikely to touch the terminal 12 by the projecting portions 43 of the protection cap 14.

This embodiment can be modified and carried out as follows. This embodiment and the following modifications can be carried out in combination without technically contradicting each other.

The configuration such as the shape of the protection cap 14 of the above embodiment is illustrative and can be appropriately changed. For example, the respective side covering portions 42 may be omitted from the protection cap 14 of the above embodiment and the front covering portion 41 may be configured to be locked to the shield member 13 (the front covering portion 41 may be configured to include a locking portion).

Although the protection cap 14 is fixed to the shield member 13 in the above embodiment, there is no limitation to this. For example, the protection cap 14 may be fixed to the housing 11, for example, as shown in FIG. 5.

Figure 5:
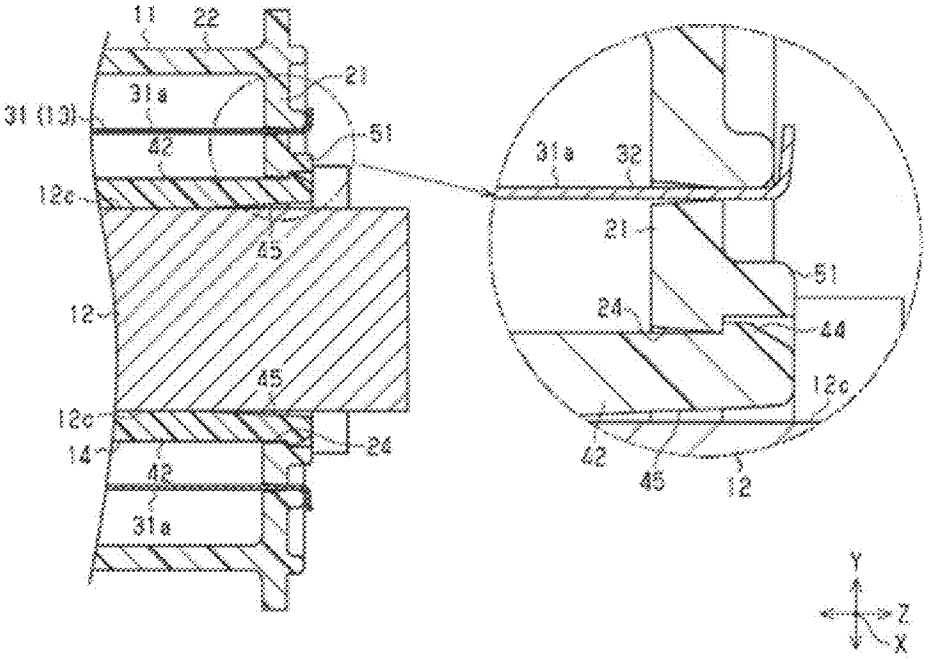
FIG. 5 is a section of a connector of a modification.

In a configuration shown in FIG. 5, the terminal insertion hole 24 formed in the base portion 21 of the housing 11 is formed to be longer in the Y-axis direction by thicknesses in the Y-axis direction of the respective side covering portions 42, and the terminal 12 and the respective side covering portions 42 are inserted into the terminal insertion hole 24. The locking claws 44 of the respective side covering portions 42 are locked to end edges in the Y-axis direction of the terminal insertion hole 24. In this way, the protection cap 14 is fixed to the housing 11.

According to this configuration, an electric shock due to the touch of the terminal 12 by a worker's finger, a tool or the like can be prevented by a simple configuration of merely assembling and fixing the protection cap 14 including the front covering portion 41 for covering the front end part 12*d* of the terminal 12 with and to the housing 11. Further, as in the above embodiment, the connector 10 can be coupled to the mating connector with the protection caps 14 assembled.

Note that, in the configuration shown in FIG. 5, protection walls 51 surrounding the locking claws 44 in a locking state stand on the back surface (surface opposite to the peripheral wall portion 22) of the base portion 21, whereby the unlocking of the locking claws 44 is suppressed. Further, in the configuration for fixing the protection cap 14 to the housing 11, the side covering portions 42 need not be in contact with the first side parts 31*a* of the shield member 13. In an example shown in FIG. 5, the side covering portions 42 and the first side parts 31*a* are separated from each other. Further, in the configuration for fixing the protection cap 14 to the housing 11, the shield member 13 can be omitted.

Further, although the side covering portions 42 penetrate through the base portion 21 in the Z-axis direction and the locking claws 44 provided on the rear end parts (free end parts) of the side covering portions 42 are locked on the back surface side of the base portion 21 in the example shown in FIG. 5, there is no particular limitation to this. For example, locked portions on the side of the housing 11 to be locked by the locking claws 44 of the protection cap 14 may be formed on the front side in the assembly direction D (side of the peripheral wall 22) of the base portion 21.

Although the one side surface in the X-axis direction of the front covering portion 41 of the protection cap 14 is flush with the plate surface 12*a* of the terminal 12 in the above embodiment, there is no particular limitation to this. If the mating terminal can climb over the front covering portion 41 and touch the plate surface 12*a* of the terminal 12 when the connector 10 is assembled with the mating connector, the one side surface of the front covering portion 41 may project further than the plate surface 12*a* of the terminal 12 (the front covering portion 41 may be wider than the terminal 12). Further, both side surfaces in the X-axis direction of the front covering portion 41 may project further than the both plate surfaces (the plate surface 12*a* forming the contact point with the mating terminal and the back of the plate surface 12*a*). Alternatively, the both side surfaces in the X-axis direction of the front covering portion 41 may be respectively flush with the both plate surfaces (the plate surface 12*a* and the back of the plate surface 12*a*) of the terminal 12.

According to the front covering portion 41 of the protection cap 14 configured to project from the plate surface of the terminal 12, a worker's finger, a tool or the like is more unlikely to touch the terminal 12. However, the mating terminal needs to climb over the front covering portion 41 when the connector 10 is assembled with the mating connector. Accordingly, by forming an inclined surface on a part of the front covering portion 41 projecting from the plate surface of the terminal 12 so that a thickness in the X-axis direction of the front covering portion 41 becomes larger toward the front end part 12*d* in the Z-axis direction, the mating terminal can be guided along the inclined surface of the front covering portion 41 and easily climb over the front covering portion 41 when the connector 10 is assembled with the mating connector.

Although the projecting portions 43 project toward one side in the X-axis direction from the both end edges in the Y-axis direction of the protection cap 14 in the above embodiment, there is no particular limitation to this. For example, the projecting portion 43 may be provided only on one end edge in the Y-axis direction of the protection cap 14. Further, the projecting portions 43 may respectively project from both sides in the X-axis direction. Further, a combination of those projecting portions 43 (the projecting portion 43 provided on one end edge in the Y-axis direction of the protection cap 14 and the projecting portions 43 respectively projecting on the both sides in the X-axis direction) may be set.

Although the projecting lengths of the projecting portions 43 from the plate surface 12*a* of the terminal 12 are set smaller than the plate thickness of the terminal 12 in the above embodiment, there is no limitation to this and the projecting lengths of the projecting portions 43 may be larger than or equal to the plate thickness of the terminal 12.

If an electric shock due to the touch of the terminal 12 by a worker's finger, a tool or the like can be prevented by properly setting the intervals (clearances) between the shield holding walls 23 and the protection cap 14, the projecting portions 43 may be omitted from the protection cap 14 of the above embodiment.

Although neither one of the both plate surfaces (the plate surface 12*a* forming the contact point with the mating terminal and the back of the plate surface 12*a*) of the terminal 12 is covered by the protection cap 14 in the above embodiment, there is no limitation to this. The protection cap 14 may be provided with a covering portion for covering the back of the plate surface 12*a* and only the plate surface 12*a* forming the contact point may be exposed.

Although the connector of the above embodiment is suitable for high-voltage application of the vehicle, the technique of the present disclosure is not particularly limited to the above embodiment and can be applied to connectors used in other than vehicles and can be applied in other than high-voltage application.

A technical idea which can be grasped from the above embodiment and modifications is described.

(A) The projecting portion of the protection cap is formed from the front covering portion to the side covering portion.

According to the above mode, a worker's finger, a tool or the like can be made more unlikely to touch the terminal.

It would be apparent to a person skilled in the art that the present invention may be embodied in other specific forms without departing the technical idea thereof. For example, some of components described in the embodiment (or one or more modes thereof) may be omitted or several components may be combined. The scope of the present invention should be determined together with the full scope of equivalents, in which claims are granted, by referring to appended claims.

LIST OF REFERENCE NUMERALS

10 . . . connector
11 . . . housing

12 . . . terminal
12*a* . . . plate surface
13 . . . shield member
14 . . . protection cap
41 . . . front covering portion
42 . . . side covering portion
43 . . . projecting portion
44 . . . locking claw (locking portion)

What is claimed is:

1. A connector, comprising:

a housing open toward a front side in an assembling direction with a mating connector, a terminal supported in the housing, the terminal being in the form of a flat plate extending in the assembling direction;

a shield member made of metal, the shield member being supported in the housing, the shield member surrounding the terminal to face the terminal in a direction orthogonal to the assembling direction; and a protection cap including a front covering portion for covering a front end part in the assembling direction of the terminal and a locking portion locked to the shield member, the protection cap being fixed to the shield member by locking of the locking portion, the connector being coupled to the mating connector with the protection cap fixed to the shield member and the front end part of the terminal covered by the front covering portion, a contact point with a mating terminal of the mating connector being provided on a plate surface of the terminal.

2. A connector, comprising:

a housing open toward a front side in an assembling direction with a mating connector, a terminal supported in the housing, the terminal being in the form of a flat plate extending in the assembling direction; and a protection cap including a front covering portion for covering a front end part in the assembling direction of the terminal and a locking portion locked to the housing, the protection cap being fixed to the housing by locking of the locking portion, the connector being coupled to the mating connector with the protection cap fixed to the housing and the front end part of the terminal covered by the front covering portion, a contact point with a mating terminal of the mating connector being provided on a plate surface of the terminal.

3. The connector of claim 1, wherein:

the protection cap includes a pair of side covering portions extending from the front covering portion to respectively cover both end parts of the terminal in a direction orthogonal to the assembling direction, and the locking portion is provided on each side covering portion.

4. The connector of claim 1, wherein the protection cap includes projecting portions projecting along a plate thickness direction of the terminal from both end parts of the front covering portion in a direction orthogonal to the assembling direction and parallel to the plate surface of the terminal.

5. The connector of claim 2, wherein:

the protection cap includes a pair of side covering portions extending from the front covering portion to respectively cover both end parts of the terminal in a direction orthogonal to the assembling direction, and the locking portion is provided on each side covering portion.

6. The connector of claim 2, wherein the protection cap includes projecting portions projecting along a plate thickness direction of the terminal from both end parts of the front covering portion in a direction orthogonal to the assembling direction and parallel to the plate surface of the terminal.

* * * * *